US010050369B1

(12) United States Patent
Yang

(10) Patent No.: US 10,050,369 B1
(45) Date of Patent: Aug. 14, 2018

(54) TERMINAL MODULE AND ELECTRICAL CONNECTOR COMPRISING THE SAME

(71) Applicant: ALL BEST PRECISION TECHNOLOGY CO., LTD., Taoyuan (TW)

(72) Inventor: Haven Yang, New Taipei (TW)

(73) Assignee: ALL BEST PRECISION TECHNOLOGY CO., LTD. (TW)

( * ) Notice: Subject to any disclaimer, the term of this patent is extended or adjusted under 35 U.S.C. 154(b) by 0 days.

(21) Appl. No.: 15/794,199

(22) Filed: Oct. 26, 2017

(51) Int. Cl.

| | |
|---|---|
| ***H01R 24/00*** | (2011.01) |
| ***H01R 13/41*** | (2006.01) |
| ***H01R 24/60*** | (2011.01) |
| ***H01R 12/72*** | (2011.01) |
| ***H01R 13/26*** | (2006.01) |
| *H01R 107/00* | (2006.01) |

(52) U.S. Cl.
CPC ..... *H01R 13/41* (2013.01); *H01R 12/721* (2013.01); *H01R 13/26* (2013.01); *H01R 24/60* (2013.01); *H01R 2107/00* (2013.01)

(58) Field of Classification Search
CPC ..... H01R 13/41; H01R 13/26; H01R 12/721; H01R 24/60; H01R 2107/00
USPC ..... 439/676, 660, 634, 636, 637
See application file for complete search history.

(56) References Cited

U.S. PATENT DOCUMENTS 4,992,052 A * 2/1991 Verhoeven ..... H01R 12/721 439/62
5,024,609 A * 6/1991 Piorunneck ..... H01R 12/721 439/60
5,052,936 A * 10/1991 Biechler ..... H01R 12/725 439/260
5,634,819 A * 6/1997 Pan ..... H01R 12/721 439/637
5,820,392 A * 10/1998 Lin ..... H01R 12/721 439/108
9,793,633 B2 * 10/2017 Liao ..... H01R 12/721
9,935,385 B2 * 4/2018 Phillips ..... H01R 12/716
9,979,136 B1 * 5/2018 Wu ..... H01R 13/6596
2007/0123109 A1 * 5/2007 Gillespie ..... H01R 13/26 439/634
2008/0070445 A1 * 3/2008 Xu ..... H01R 12/721 439/626

(Continued)

*Primary Examiner* — Abdullah Riyami
*Assistant Examiner* — Nelson R Burgos-Guntin
(74) *Attorney, Agent, or Firm* — Schmeiser, Olsen & Watts, LLP

(57) ABSTRACT

A terminal module comprises a connecting element having second and third slots; a second terminal unit disposed at the second slots; a third terminal unit disposed at the third slots and opposite the second terminal unit; a first terminal module disposed beneath the connecting element to clamp the second terminal unit and comprising a first terminal unit; and a fourth terminal module disposed on the connecting element to clamp the third terminal unit and comprising a fourth terminal unit opposite the first terminal unit. The second and third terminal units are disposed behind the first and fourth terminal units. A ground terminal and two signal terminals are disposed at one or two sides of the first, second, third and/or fourth terminal units. The ground terminal is the outermost one. An electrical connector is provided and comprises a casing and the terminal module disposed therein.

20 Claims, 7 Drawing Sheets

(56) References Cited

U.S. PATENT DOCUMENTS

| | | | | |
|---|---|---|---|---|
| 2012/0003875 | A1* | 1/2012 | Akai | H01R 12/716 439/660 |
| 2015/0155665 | A1* | 6/2015 | Su | H01R 13/6477 439/676 |
| 2015/0236437 | A1* | 8/2015 | Briant | H01R 12/737 439/636 |
| 2015/0244117 | A1* | 8/2015 | Kawamura | H01R 24/60 439/676 |
| 2016/0079709 | A1* | 3/2016 | Su | H01R 13/6477 439/660 |
| 2017/0033511 | A1* | 2/2017 | Hsu | H01R 13/6596 |
| 2017/0170606 | A1* | 6/2017 | Phillips | H01R 13/6585 |

* cited by examiner

TERMINAL MODULE AND ELECTRICAL CONNECTOR COMPRISING THE SAME

FIELD OF THE INVENTION

The present invention relates to terminal modules and electrical connectors comprising the terminal modules and, more particularly, to a terminal module and an electrical connector comprising the terminal module, which involve using an electronic plug-in plate.

BACKGROUND OF THE INVENTION

A conventional electrical connector which an electronic plug-in plate is plugged in usually comprises a casing, four terminal units, and at least four supports. The terminal units are arranged in upper and lower rows and disposed at the supports. Afterward, the supports which hold the terminal units are sequentially disposed in the casing to finalize the assembly of the electrical connector.

To fit related electronic products, the conventional electrical connector has to be lightweight, thin, short and compact, and thus terminals of the terminal units have to be small. After the terminals of the terminal units have been mounted on the supports, the supports which hold the terminal units have to be placed one by one and sequentially inside the casing. As a result, the assembly process is accompanied by mutual interference between the terminal units, leading to the bending and even damaging of the terminals of the terminal units to the detriment of the yield and use of the electrical connector.

Accordingly, it is imperative to provide a terminal module and an electrical connector comprising the terminal module and thereby overcome the aforesaid drawbacks of the prior art.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a terminal module and an electrical connector comprising the terminal module as disclosed in the present invention to enable quick assembly, ensure ease of manufacturing, and enhance yield.

In order to achieve the above and other objectives, the present invention provides a terminal module and an electrical connector comprising the terminal module. The terminal module comprises a connecting element, a second terminal unit, a third terminal unit, a first terminal module and a fourth terminal module. Second slots are disposed at the bottom of the connecting element, whereas third slots are disposed at the top of the connecting element. The second terminal unit is disposed at the second slots. The third terminal unit is disposed at the third slots and corresponds in position to the second terminal unit. The first terminal module is disposed at the bottom of the connecting element to clamp the second terminal unit and comprises a first terminal unit. The fourth terminal module is disposed at the top of the connecting element to clamp the third terminal unit and comprises a fourth terminal unit corresponding in position to the first terminal unit, wherein the second terminal unit and the third terminal unit are disposed behind the first terminal unit and the fourth terminal unit;

A ground terminal, a signal terminal and a signal terminal are disposed at at least one side of at least one of the first terminal unit, the second terminal unit, the third terminal unit and the fourth terminal unit, with the ground terminal being an outermost one.

Regarding the terminal module, the first terminal module further comprises a first base having a top provided with at least one first adjoining portion coupled to at least one first engaging portion disposed at the bottom of the connecting element.

Regarding the terminal module, the fourth terminal module further comprises a fourth base having a bottom provided with at least one fourth adjoining portion coupled to at least one second engaging portion disposed at the top of the connecting element.

Regarding the terminal module, the connecting element is integrally formed.

Regarding the terminal module, the connecting element comprises a first foundation and a second foundation, with two coupling portions disposed on the first and second foundations, respectively, corresponding in position to each other, and coupling the first and second foundations together so as to form the connecting element.

Regarding the terminal module, the second terminal unit comprises second terminals each having a body portion, allowing a contacting end and a connecting end to be disposed at two ends of the body portion, respectively, the body portions being engaged with the second slots, respectively, and the contacting ends being disposed at a top of the first terminal module.

Regarding the terminal module, the third terminal unit comprises third terminals each having a body portion, allowing a contacting end and a connecting end to be disposed at two ends of the body portion, respectively, the body portions being engaged with the third slots, respectively, and the contacting ends being disposed at a bottom of the fourth terminal module.

Regarding the terminal module, the first terminal module further comprises a first base, a first pressing plate and a first ground element, with first slots disposed at a bottom of the first base, first receiving recesses disposed at a top of the first base, the first terminal unit disposed at the first slots, the second terminal unit disposed at the second slots, wherein contacting ends of the second terminal unit are received in the first receiving recesses, allowing the first pressing plate to be coupled to the first base to constrain the first terminal unit, the first ground element to be coupled to the first base, and the first ground element to be in contact with the ground terminal of the first terminal unit.

Regarding the terminal module, a first fixing portion and a first connecting portion are disposed at the two sides of a bottom of the first base, respectively, with first corresponding fixing portions disposed at two ends of the first pressing plate and coupled to the first fixing portions, respectively, with first corresponding connecting portions disposed at two ends of the first ground element and coupled to the first connecting portions, respectively, with bumps disposed at a top of the first pressing plate and engaged with the first slots, respectively, to press against the first terminal unit, with extending portions disposed at an edge of the first ground element and being in contact with the ground terminal of the first terminal unit.

Regarding the terminal module, the first terminal unit comprises first terminals each having a body portion, allowing a contacting end and a connecting end to be disposed at two ends of the body portion, respectively, the body portions being engaged with the first slots, respectively, to press against the bumps of the first pressing plate, and the extending portions of the first ground element are in contact with the body portions of part of the first terminals.

Regarding the terminal module, the fourth terminal module further comprises a fourth base, a fourth pressing plate and a fourth ground element, with fourth slots disposed at a top of the fourth base, with fourth receiving recesses disposed at a bottom of the fourth base, with the fourth terminal unit disposed at the fourth slots, with the third terminal unit disposed at the third slots, allowing the contacting ends of the third terminal unit to be received in the fourth receiving recesses, allowing the fourth pressing plate to be coupled to the fourth base to constrain the fourth terminal unit, allowing the fourth ground element to be coupled to the fourth base, and allowing the fourth ground element to be in contact with the ground terminal of the fourth terminal unit.

Regarding the terminal module, a fourth fixing portion and a fourth connecting portion are disposed at two sides of a top of the fourth base, respectively, with fourth corresponding fixing portions disposed at two ends of the fourth pressing plate and coupled to the fourth fixing portions, respectively, with fourth corresponding connecting portion disposed at two ends of the fourth ground element and coupled to the fourth connecting portions, respectively, with bumps disposed at a bottom of the fourth pressing plate and engaged with the fourth slots, respectively, to press against the fourth terminal unit, and extending portions are disposed at an edge of the fourth ground element and in contact with the ground terminal of the fourth terminal unit.

Regarding the terminal module, the fourth terminal unit comprises fourth terminals each having a body portion, allowing a contacting end and a connecting end to be disposed at two ends of the body portion, respectively, the body portions being engaged with the fourth slots, respectively, to press against the bumps of the fourth pressing plate, and the extending portions of the fourth ground element are in contact with the body portions of part of the fourth terminals.

The electrical connector of the present invention comprises a casing and the terminal module disposed therein.

Regarding the electrical connector, the casing comprises a housing and a rear lid. The housing contains the terminal module. The rear lid is coupled to the housing to confine the terminal module to the housing.

Regarding the electrical connector, the housing has a receiving region. The receiving region contains the terminal module. A mouth disposed at one end of the housing, with grooves disposed on two inner sides at an end of the housing and being in communication with the mouth. The contacting ends of the first terminals and the contacting ends of the fourth terminals are received in the grooves, respectively, with an opening disposed at a bottom of the housing and being in communication with the receiving region. The opening contains the connecting ends of the first terminals, the connecting ends of the second terminals, the connecting ends of the third terminals, and the connecting ends of the fourth terminals.

Regarding the electrical connector, channels are disposed inwardly on two inner walls of the housing, with fixing holes disposed on the two inner walls of the housing to communicate with the channels, respectively, and the rear lid comprises a baffle and two lateral plates which flank the baffle, the lateral plates each having guide portions and hook portions, and coupling the rear lid and the housing together allows insertion of the guide portions and the hook portions into the channels as well as snap engagement of the hook portions with the fixing holes.

Regarding the electrical connector, the baffle has limiting notches. The limiting notches constrain the connecting ends of the fourth terminals as a result of coupling the rear lid and the housing together.

Regarding the electrical connector, two through holes opposite each other are disposed on two sidewalls of the housing, respectively, and positioned proximate to the opening, and a supporting plate is inserted into each of the through holes so that the connecting ends of the first terminals, the connecting ends of the second terminals, the connecting ends of the third terminals, and the connecting ends of the fourth terminals press against the supporting plates.

A terminal module and an electrical connector comprising the terminal module according to the present invention are characterized in that a first terminal unit, second terminal unit, third terminal unit and fourth terminal unit are integrated by a connecting element to form a terminal module, and then the terminal module is placed inside the casing to form the electrical connector, so as to enable quick assembly, ensure ease of manufacturing, and enhance yield.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
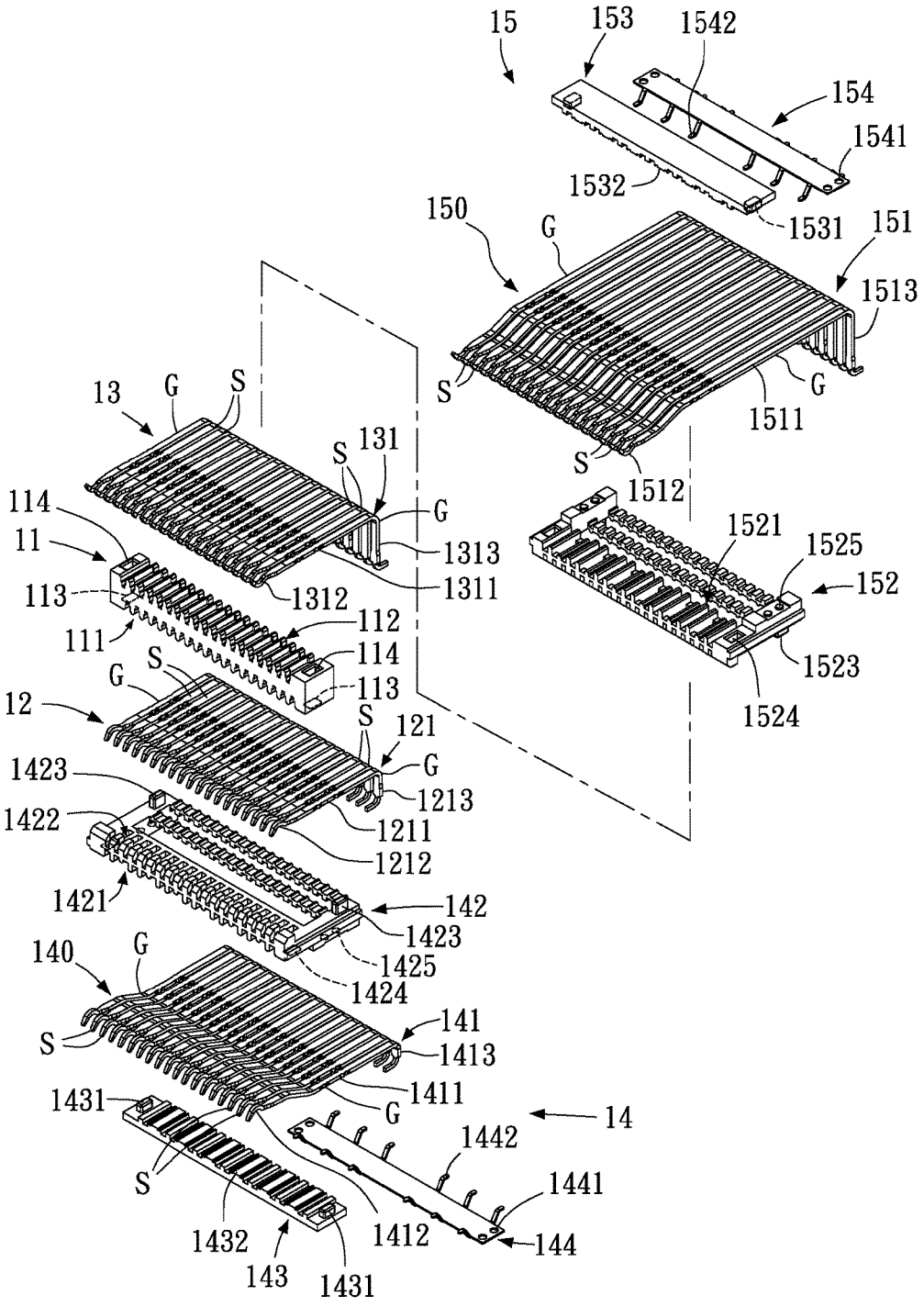
FIG. 1 is an exploded view of a terminal module according to a preferred embodiment of the present invention.
Figure 2:
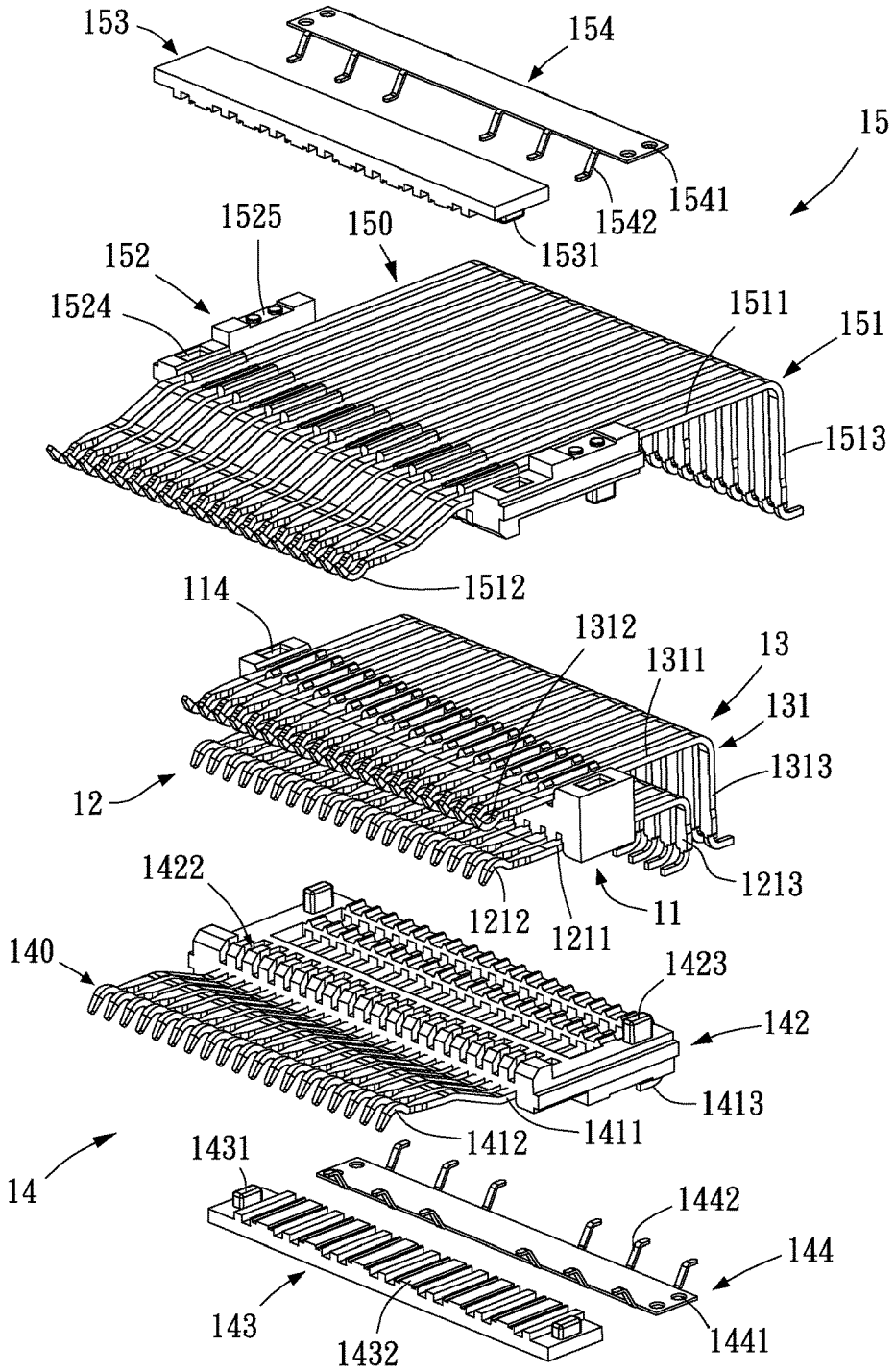
FIG. 2 is a partial exploded view of the terminal module according to the preferred embodiment of the present invention.
Figure 3:
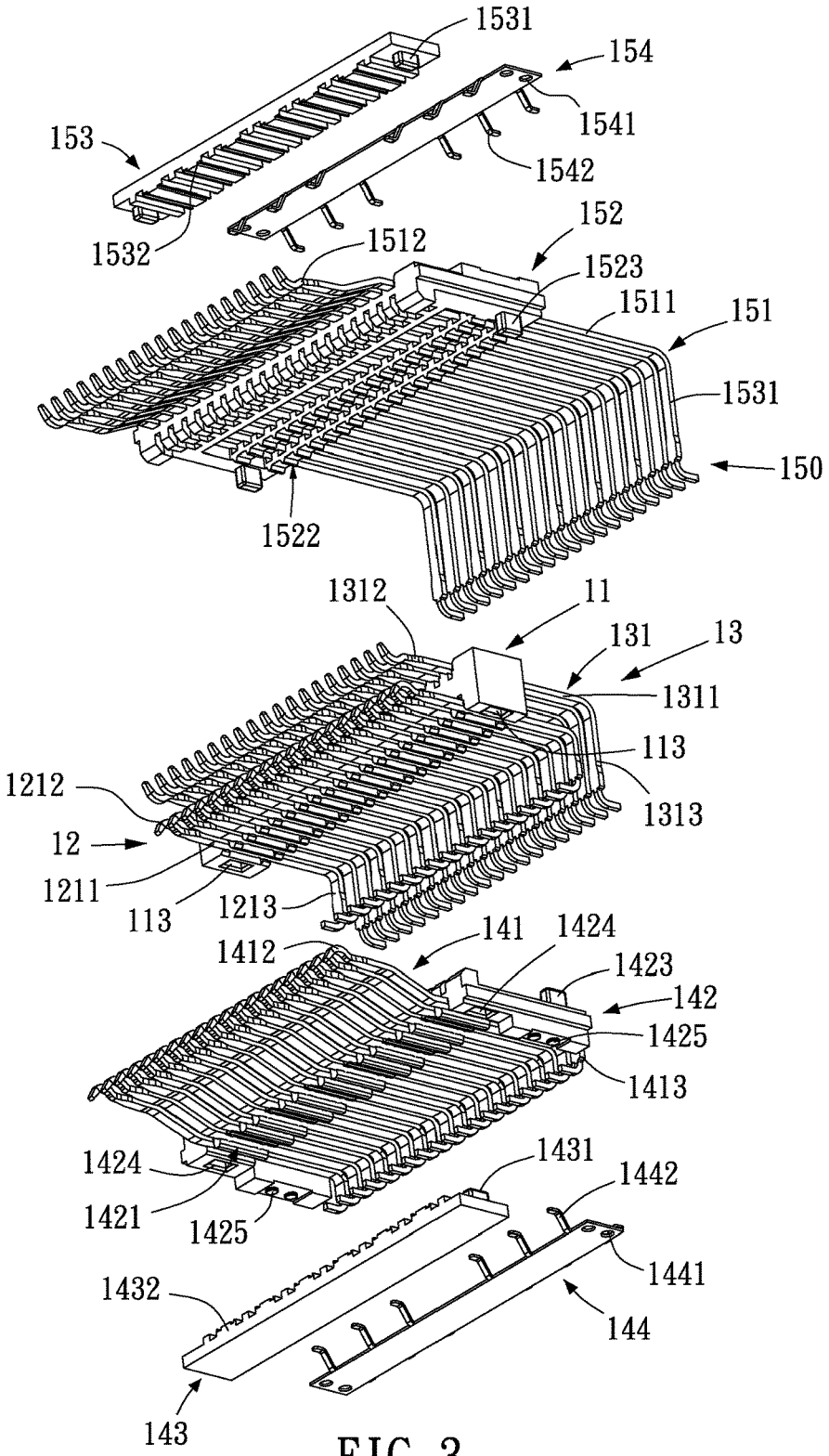
FIG. 3 is another partial exploded view of the terminal module according to the preferred embodiment of the present invention.
Figure 4:
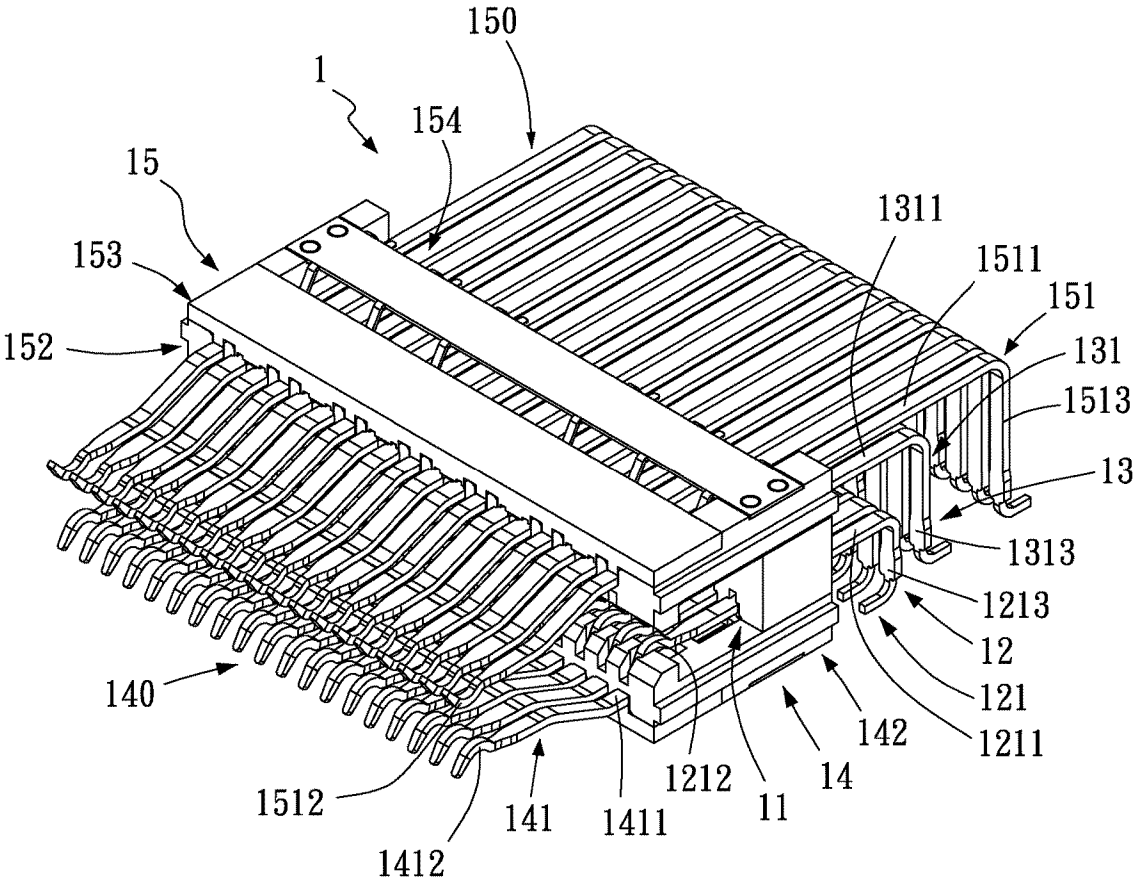
FIG. 4 is a perspective view of the terminal module according to the preferred embodiment of the present invention.

Referring to FIG. 1 through FIG. 4, the present invention provides a terminal module and an electrical connector comprising the terminal module. The terminal module 1 comprises a connecting element 11, a second terminal unit 12, a third terminal unit 13, a first terminal module 14 and a fourth terminal module 15.

Second slots 111 are disposed at the bottom of the connecting element 11. Third slots 112 are disposed at the top of the connecting element 11.

The second terminal unit 12 is disposed at the second slots 111.

The third terminal unit 13 is disposed at the third slots 112. The third terminal unit 13 and the second terminal unit 12 correspond in position to each other so as to be in electrical contact with an electronic plug-in plate.

The first terminal module 14 is disposed at the bottom of the connecting element 11 to clamp the second terminal unit 12. The first terminal module 14 comprises a first terminal unit 140.

The fourth terminal module 15 is disposed at the top of the connecting element 11 to clamp the third terminal unit 13. The fourth terminal module 15 comprises a fourth terminal unit 150. The fourth terminal unit 150 and the first terminal unit 140 correspond in position to each other so as to be in electrical contact with the electronic plug-in plate. The second terminal unit 12 and the third terminal unit 13 are disposed between the first terminal unit 140 and the fourth terminal unit 150. the contacting end 1212 of the second terminal unit 12 and the contacting end 1312 of the third terminal unit 13 are disposed behind the contacting end 1412 of the first terminal unit 140 and the contacting end 1512 of the fourth terminal unit 150.

A ground terminal G, a signal terminal S and a signal terminal S are disposed at the left side, right side, or left and right sides of at least one of the first terminal unit 140, the second terminal unit 12, the third terminal unit 13 and the fourth terminal unit 150, with the ground terminal(s) G being the outermost one(s). Therefore, the terminal module of the present invention is applicable to QSFP-DD electrical connector and SFP-DD electrical connector.

In a preferred embodiment of the present invention, the first terminal module 14 further comprises a first base 142. At least one first adjoining portion 1423 is disposed at the top of the first base 142. The first adjoining portion 1423 is coupled to at least one first engaging portion 113 disposed at the bottom of the connecting element 11. The fourth terminal module 15 further comprises a fourth base 152. At least one fourth adjoining portion 1523 is disposed at the bottom of the fourth base 152. The fourth adjoining portion 1523 is coupled to at least one second engaging portion 114 disposed at the top of the connecting element 11.

In a preferred embodiment of the present invention, the connecting element 11 is integrally formed. The first engaging portion 113 is disposed at each of the two ends of the bottom of the connecting element 11. The second engaging portion 114 is disposed at each of the two ends of the top of the connecting element 11. The first engaging portion 113 is connected to the first adjoining portion 1423 of the first terminal module 14. The second engaging portion 114 is connected to the fourth adjoining portion 1523 of the fourth terminal module 15.

In a preferred embodiment of the present invention, the second terminal unit 12 comprises second terminals 121. The second terminals 121 each have a body portion 1211. A contacting end 1212 and a connecting end 1213 are disposed at two ends of the body portion 1211, respectively. The third terminal unit 13 comprises third terminals 131. The third terminals 131 each have a body portion 1311. A contacting end 1312 and a connecting end 1313 are disposed at two ends of the body portion 1311, respectively.

In a preferred embodiment of the present invention, the first terminal unit 140 of the first terminal module 14 comprises first terminals 141. The first terminals 141 each have a body portion 1411. A contacting end 1412 and a connecting end 1413 are disposed at two ends of the body portion 1411, respectively. The first terminal module 14 further comprises a first base 142, a first pressing plate 143 and a first ground element 144. First slots 1421 are disposed at the bottom of the first base 142. First receiving recesses 1422 are disposed at the top of the first base 142. A first adjoining portion 1423 is disposed at each of the two ends of the top of the first base 142. A first fixing portion 1424 and a first connecting portion 1425 are disposed at the two sides of the bottom of the first base 142, respectively. The body portions 1411 of the first terminals 141 of the first terminal unit 140 are engaged with the first slots 1421, respectively. First corresponding fixing portions 1431 are disposed at two ends of the first pressing plate 143 and coupled to the first fixing portions 1424, respectively. Bumps 1432 are disposed at the top of the first pressing plate 143. The bumps 1432 are engaged with the first slots 1421, respectively, so that the body portions 1411 of the first terminals 141 are engaged with the first slots 1421 to press against the bumps 1432; hence, the first pressing plate 143 is coupled to the first base 142 to constrain the first terminal unit 140. First corresponding connecting portions 1441 are disposed at two ends of the first ground element 144 and coupled to the first connecting portions 1425, respectively. Extending portions 1442 are disposed at the edge of the first ground element 144; hence, with the first ground element 144 being coupled to the first base 142, the first ground element 144 is in contact with the ground terminal G of the first terminal unit 140, and the extending portions 1442 are in contact with the body portions 1411 of the ground terminal G in the first terminals 141.

In a preferred embodiment of the present invention, the fourth terminal unit 150 of the fourth terminal module 15 comprises fourth terminals 151. The fourth terminals 151 each have a body portion 1511. A contacting end 1512 and a connecting end 1513 are disposed at two ends of the body portion 1511, respectively. The fourth terminal module 15 further comprises a fourth base 152, a fourth pressing plate 153 and a fourth ground element 154. Fourth slots 1521 are disposed at the top of the fourth base 152. Fourth receiving recesses 1522 are disposed at the bottom of the fourth base 152. A fourth adjoining portion 1523 is dispose at each of the two ends of the bottom of the fourth base 152. A fourth fixing portion 1524 and a fourth connecting portion 1525 are disposed at two sides of the top of the fourth base 152, respectively. The body portions 1511 of the fourth terminals 151 of the fourth terminal unit 150 are engaged with the fourth slots 1521, respectively. Fourth corresponding fixing portions 1531 are disposed at two ends of the fourth pressing plate 153 and coupled to the fourth fixing portions 1524, respectively. Bumps 1532 are disposed at the bottom of the fourth pressing plate 153. The bumps 1532 are engaged with the fourth slots 1521, respectively, so that the body portions 1511 of the fourth terminals 151 are engaged with the fourth slots 1521 to press against the bumps 1532; hence, the fourth pressing plate 153 is coupled to the fourth base 152 to constrain the fourth terminal unit 150. Fourth corresponding connecting portions 1541 are disposed at two ends of the fourth ground element 154 and coupled to the fourth connecting portions 1525, respectively. Extending portions 1542 are disposed at the edge of the fourth ground element 154; hence, with the fourth ground element 154 being coupled to the fourth base 152, the fourth ground element 154 is in contact with the ground terminal G of the fourth terminal unit 150, and the extending portions 1542 are in contact with the body portions 1511 of the ground terminal G in the fourth terminals 151.

Assembly of the terminal module 1 comprises the steps of: fastening the body portions 1211 of the second terminals 121 of the second terminal unit 12 to the second slots 111 of the connecting element 11, respectively; fastening the body portions 1311 of the third terminals 131 of the third terminal unit 13 to the third slots 112 of the connecting element 11, respectively; connecting the first adjoining portions 1423 disposed at the two ends of the first base 142 of the first terminal module 14 to the first engaging portions 113 disposed at the two ends of the bottom of the connecting element 11, respectively, so that not only is the first terminal module 14 coupled to the bottom of the connecting element 11, but the contacting end 1212 of the second terminal unit 12 are also received in the first receiving recesses 1422 on the top of the first base 142; and connecting the fourth adjoining portions 1523 disposed at two ends of the fourth base 152 of the fourth terminal module 15 to the second engaging portions 114 disposed at the two ends of the top of the connecting element 11, respectively, so that the contacting end 1312 of the third terminal unit 13 are received in the fourth receiving recesses 1522 at the bottom of the fourth base 152.

Figure 5:
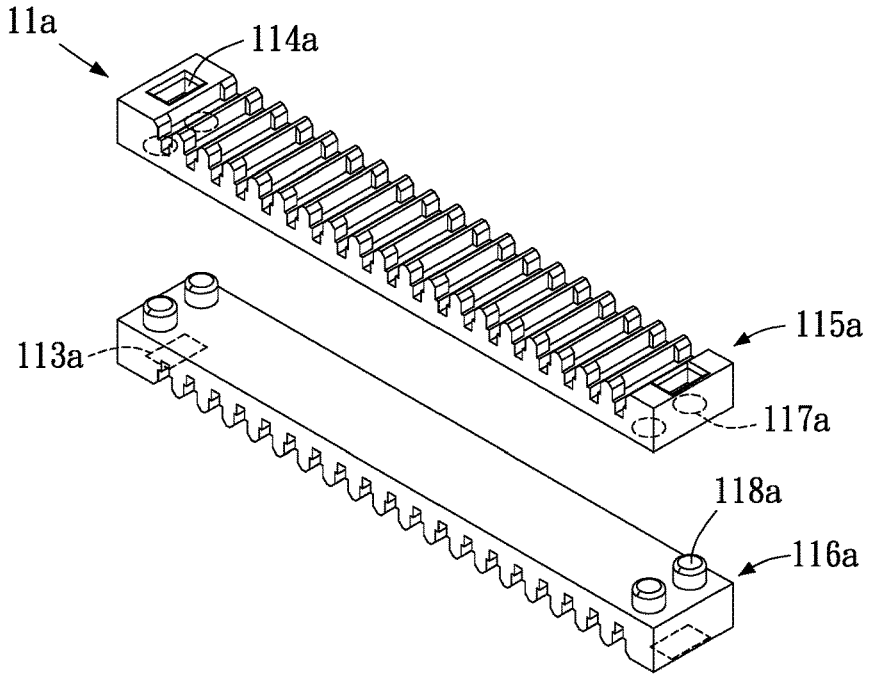
FIG. 5 is an exploded view of a connecting element according to another preferred embodiment of the present invention.
Figure 6:
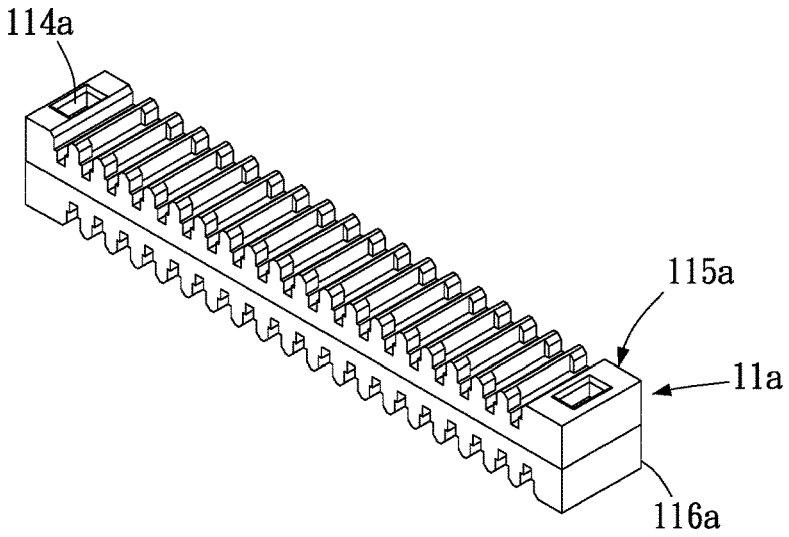
FIG. 6 is a perspective view of the connecting element according to another preferred embodiment of the present invention.

Referring to FIG. 5 and FIG. 6, in another preferred embodiment of a connecting element 11*a* of the present invention, the connecting element 11*a* comprises a first foundation 115*a* and a second foundation 116*a*. A coupling portion 117*a* is disposed on the first foundation 115*a*. A coupling portion 118*a* is disposed on the second foundation 116*a*. The coupling portions 117*a*, 118*a* face each other, correspond in position to each other, and are engaged with each other to couple the first foundation 115*a* and the second foundation 116*a* together. In this embodiment, the coupling portions 117*a*, 118*a* are recess and post; however, in practice, the first and second foundations 115*a*, 116*a* are snap-engaged together or adhered together. A first engaging portion 113*a* is disposed at each of the two ends of the second foundation 116*a* and connected to a first adjoining portion (not shown) of the first terminal module 14. A second engaging portion 114*a* is disposed at each of the two ends of the first foundation 115*a* and connected to a fourth adjoining portion (not shown) of the fourth terminal module 15.

Figure 7:
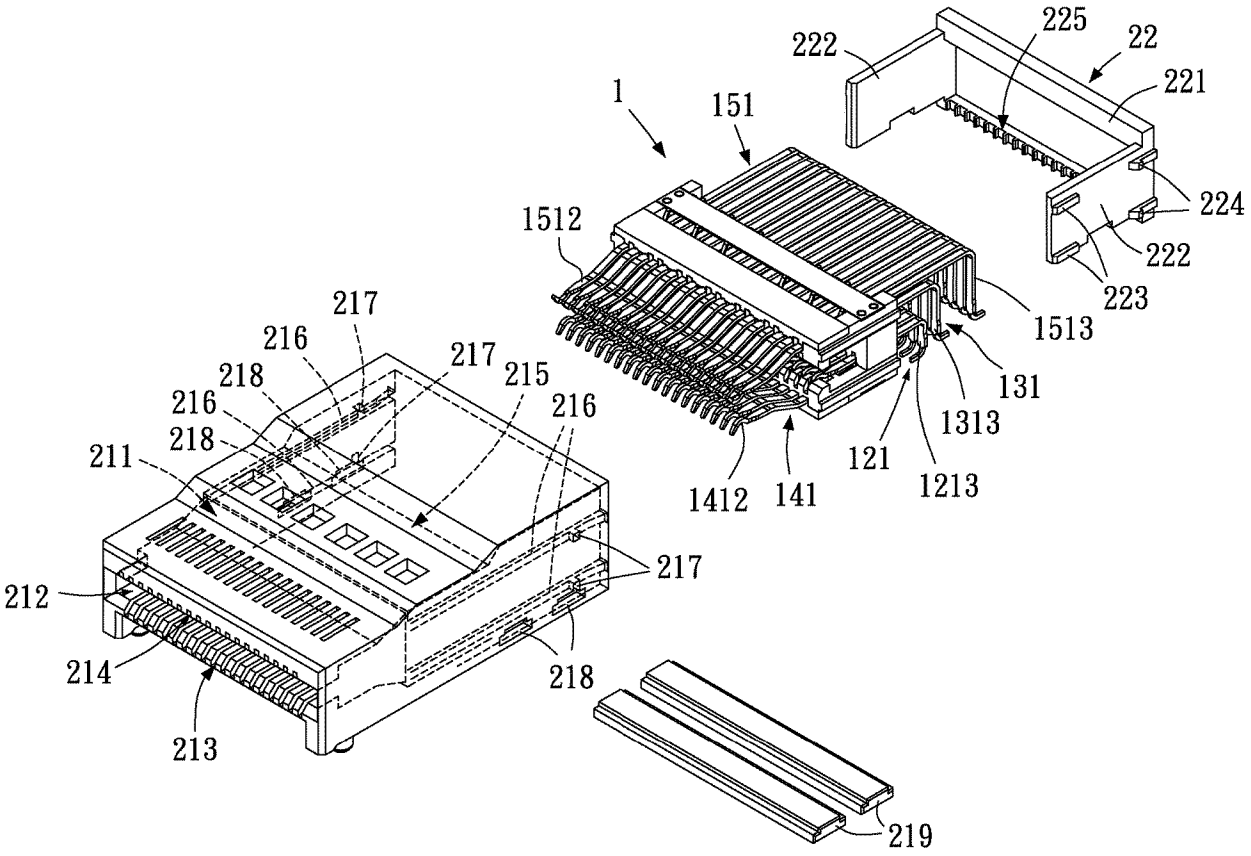
FIG. 7 is an exploded view of an electrical connector according to the preferred embodiment of the present invention.
Figure 8:
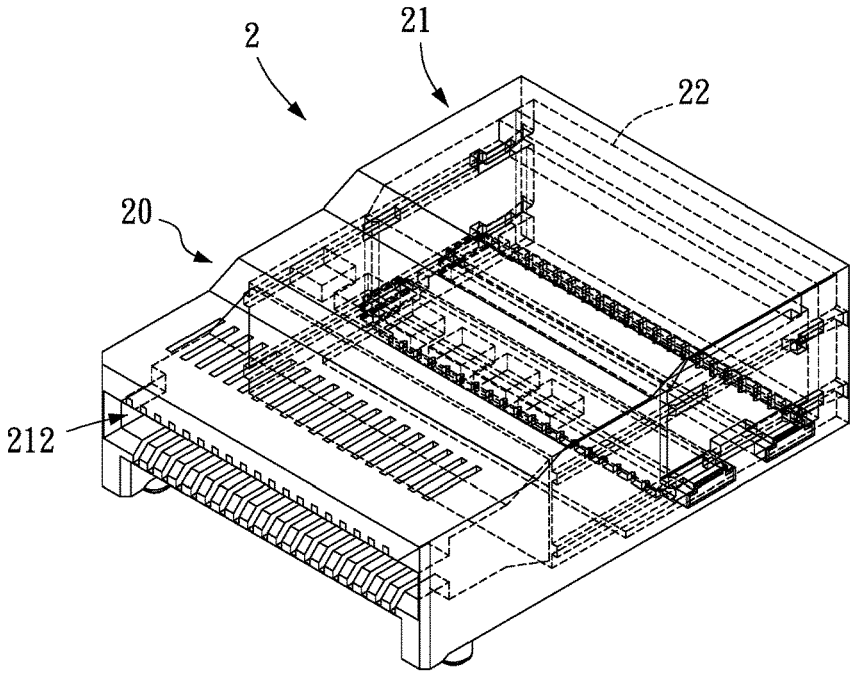
FIG. 8 is a perspective view of the electrical connector according to the preferred embodiment of the present invention.
Figure 9:
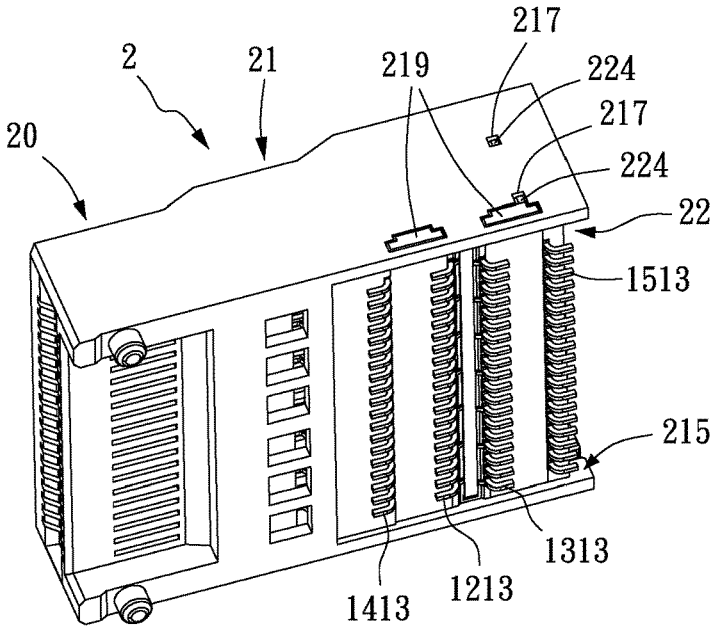
FIG. 9 is another perspective view of the electrical connector according to the preferred embodiment of the present invention.

Referring to FIG. 7 through FIG. 9, an electrical connector 2 of the present invention comprises a terminal module 1 and a casing 20. The terminal module 1 is disposed in the casing 20. The casing 20 comprises a housing 21 and a rear lid 22. The housing 21 contains the terminal module 1. The rear lid 22 is coupled to the housing 21 to confine the terminal module 1 to the housing 1.

In a preferred embodiment of the present invention, the housing 21 has a receiving region 211. The receiving region 211 contains the terminal module 1. A mouth 212 is disposed at one end of the housing 21. Grooves 213, 214 are disposed on the top side and the bottom side at one end of the housing 21 and are in communication with the mouth 212. The contacting ends 1412 of the first terminals 141 and the contacting ends 1512 of the fourth terminals 151 are received in the grooves 213, 214, respectively. An opening 215 is disposed at the bottom of the housing 21 and is in communication with the receiving region 211. The opening 215 contains the connecting ends 1413 of the first terminals 141, the connecting ends 1213 of the second terminals 121, the connecting ends 1313 of the third terminals 131, and the connecting ends 1513 of the fourth terminals 151.

Channels 216 are disposed inwardly on the left wall and right wall of the housing 21. Fixing holes 217 are disposed on the left wall and right wall of the housing 21 to communicate with the channels 216, respectively. The rear lid 22 comprises a baffle 221 and two lateral plates 222 which flank the baffle 221. The lateral plates 222 each have guide portions 223 and hook portions 224. Coupling the rear lid 22 and the housing 21 together allows insertion of the guide portions 223 and the hook portions 224 into the channels 216 as well as snap engagement of the hook portions 224 with the fixing holes 217. The baffle 221 has limiting notches 225. After the rear lid 22 has been coupled to the housing 21, the limiting notches 225 constrain the connecting ends 1413 of the first terminals 141. Two through holes 218 opposite each other are disposed on the left sidewall and the right sidewall of the housing 21, respectively, and positioned proximate to the opening 215. A supporting plate 219 is inserted into each of the through holes 218; hence, the connecting ends 1413 of the first terminals 141, the connecting ends 1213 of the second terminals 121, the connecting ends 1313 of the third terminals 131, and the connecting ends 1513 of the fourth terminals 151 press against the supporting plates 219. At this point in time, the assembly of the electrical connector 2 is done.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A terminal module, comprising:
   - a connecting element having a bottom provided with second slots and having a top provided with third slots;
   - a second terminal unit disposed at the second slots;
   - a third terminal unit disposed at the third slots and corresponding in position to the second terminal unit;
   - a first terminal module disposed at the bottom of the connecting element to clamp the second terminal unit and comprising a first terminal unit; and
   - a fourth terminal module disposed at the top of the connecting element to clamp the third terminal unit and comprising a fourth terminal unit corresponding in position to the first terminal unit, wherein the second terminal unit and the third terminal unit are disposed behind the first terminal unit and the fourth terminal unit;
   - wherein a ground terminal and a signal terminal are disposed at at least one side of at least one of the first terminal unit, the second terminal unit, the third terminal unit and the fourth terminal unit, with the ground terminal being an outermost one.

2. The terminal module of claim 1, wherein the first terminal module further comprises a first base having a top provided with at least one first adjoining portion coupled to at least one first engaging portion disposed at the bottom of the connecting element.

3. The terminal module of claim 1, wherein the fourth terminal module further comprises a fourth base having a bottom provided with at least one fourth adjoining portion coupled to at least one second engaging portion disposed at the top of the connecting element.

4. The terminal module of claim 2, wherein the fourth terminal module further comprises a fourth base having a bottom provided with at least one fourth adjoining portion coupled to at least one second engaging portion disposed at the top of the connecting element.

5. The terminal module of claim 1, wherein the connecting element is integrally formed.

6. The terminal module of claim 1, wherein the connecting element comprises a first foundation and a second foundation, with two coupling portions disposed on the first and second foundations, respectively, corresponding in position to each other, and coupling the first and second foundations together so as to form the connecting element.

7. The terminal module of claim 1, wherein the second terminal unit comprises second terminals each having a body portion, allowing a contacting end and a connecting end to be disposed at two ends of the body portion, respectively, the body portions being engaged with the second slots, respectively, and the contacting ends being disposed at a top of the first terminal module.

8. The terminal module of claim 1, wherein the third terminal unit comprises third terminals each having a body portion, allowing a contacting end and a connecting end to be disposed at two ends of the body portion, respectively, the body portions being engaged with the third slots, respectively, and the contacting ends being disposed at a bottom of the fourth terminal module.

9. The terminal module of claim 1, wherein the first terminal module further comprises a first base, a first pressing plate and a first ground element, with first slots disposed at a bottom of the first base, first receiving recesses disposed at a top of the first base, the first terminal unit disposed at the first slots, the second terminal unit disposed at the second slots, wherein contacting ends of the second terminal unit are received in the first receiving recesses, allowing the first pressing plate to be coupled to the first base to constrain the first terminal unit, the first ground element to be coupled to the first base, and the first ground element to be in contact with the ground terminal of the first terminal unit.

10. The terminal module of claim 9, wherein a first fixing portion and a first connecting portion are disposed at the two sides of a bottom of the first base, respectively, with first corresponding fixing portions disposed at two ends of the first pressing plate and coupled to the first fixing portions, respectively, with first corresponding connecting portions disposed at two ends of the first ground element and coupled to the first connecting portions, respectively, with bumps disposed at a top of the first pressing plate and engaged with the first slots, respectively, to press against the first terminal unit, with extending portions disposed at an edge of the first ground element and being in contact with the ground terminal of the first terminal unit.

11. The terminal module of claim 10, wherein the first terminal unit comprises first terminals each having a body portion, allowing a contacting end and a connecting end to be disposed at two ends of the body portion, respectively, the body portions being engaged with the first slots, respectively, to press against the bumps of the first pressing plate, and the extending portions of the first ground element are in contact with the body portions of part of the first terminals.

12. The terminal module of claim 1, wherein the fourth terminal module further comprises a fourth base, a fourth pressing plate and a fourth ground element, with fourth slots disposed at a top of the fourth base, with fourth receiving recesses disposed at a bottom of the fourth base, with the fourth terminal unit disposed at the fourth slots, with the third terminal unit disposed at the third slots, allowing the contacting ends of the third terminal unit to be received in the fourth receiving recesses, allowing the fourth pressing plate to be coupled to the fourth base to constrain the fourth terminal unit, allowing the fourth ground element to be coupled to the fourth base, and allowing the fourth ground element to be in contact with the ground terminal of the fourth terminal unit.

13. The terminal module of claim 12, wherein a fourth fixing portion and a fourth connecting portion are disposed at two sides of a top of the fourth base, respectively, with fourth corresponding fixing portions disposed at two ends of the fourth pressing plate and coupled to the fourth fixing portions, respectively, with fourth corresponding connecting portion disposed at two ends of the fourth ground element and coupled to the fourth connecting portions, respectively, with bumps disposed at a bottom of the fourth pressing plate and engaged with the fourth slots, respectively, to press against the fourth terminal unit, and extending portions are disposed at an edge of the fourth ground element and in contact with the ground terminal of the fourth terminal unit.

14. The terminal module of claim 13, wherein the fourth terminal unit comprises fourth terminals each having a body portion, allowing a contacting end and a connecting end to be disposed at two ends of the body portion, respectively, the body portions being engaged with the fourth slots, respectively, to press against the bumps of the fourth pressing plate, and the extending portions of the fourth ground element are in contact with the body portions of part of the fourth terminals.

15. An electrical connector, comprising a casing and the terminal module of claim 1, with the terminal module disposed in the casing.

16. The electrical connector of claim 15, wherein the casing comprises a housing and a rear lid, the housing containing the terminal module, and the rear lid being coupled to the housing to confine the terminal module to the housing.

17. The electrical connector of claim 16, wherein the housing has a receiving region, the receiving region containing the terminal module, with a mouth disposed at an end of the housing, with grooves disposed on two inner sides at an end of the housing and being in communication with the mouth, the contacting ends of the first terminals and the contacting ends of the fourth terminals are received in the grooves, respectively, with an opening disposed at a bottom of the housing and being in communication with the receiving region, the opening containing the connecting ends of the first terminals, the connecting ends of the second terminals, the connecting ends of the third terminals, and the connecting ends of the fourth terminals.

18. The electrical connector of claim 17, wherein channels are disposed inwardly on two inner walls of the housing, with fixing holes disposed on the two inner walls of the housing to communicate with the channels, respectively, and the rear lid comprises a baffle and two lateral plates which flank the baffle, the lateral plates each having guide portions and hook portions, and coupling the rear lid and the housing together allows insertion of the guide portions and the hook portions into the channels as well as snap engagement of the hook portions with the fixing holes.

19. The electrical connector of claim 18, wherein the baffle has limiting notches, and the limiting notches constrain the connecting ends of the fourth terminals as a result of coupling the rear lid and the housing together.

20. The electrical connector of claim 19, wherein two through holes opposite each other are disposed on two sidewalls of the housing, respectively, and positioned proximate to the opening, and a supporting plate is inserted into each of the through holes so that the connecting ends of the first terminals, the connecting ends of the second terminals, the connecting ends of the third terminals, and the connecting ends of the fourth terminals press against the supporting plates.

* * * * *